US005299700A

United States Patent [19]

Beniacar

[11] Patent Number: 5,299,700

[45] Date of Patent: Apr. 5, 1994

[54] CONTAINER WITH COMPOSITE STRUCTURE

[76] Inventor: Giacomo Beniacar, Via C. Troya, 22-20144, Milan, Italy

[21] Appl. No.: 920,040

[22] Filed: Jul. 27, 1992

[30] Foreign Application Priority Data

Aug. 2, 1991 [IT] Italy ..... 002165 91/A

[51] Int. Cl.[5] ..... B65D 23/08

[52] U.S. Cl. ..... 215/12.1; 215/1 C; 215/100 R; 220/410; 220/737; 206/485

[58] Field of Search ..... 215/1 C, 12.1, 100 R; 220/403, 410, 411, 461, 462, 737; 206/485

[56] References Cited

U.S. PATENT DOCUMENTS

| | | | |
|---|---|---|---|
| 2,017,427 | 10/1935 | Williams | 215/12.1 |
| 2,090,320 | 8/1937 | Amick | 215/12.1 |
| 2,364,753 | 12/1944 | Richter | 215/12.1 |
| 3,163,544 | 12/1964 | Valyi | 220/462 X |
| 3,285,461 | 11/1966 | Santelli | 220/462 X |
| 4,456,134 | 6/1984 | Cooper | 215/12.1 |
| 4,635,814 | 1/1987 | Jones | 220/403 |
| 4,782,945 | 11/1988 | Geiler et al. | 215/12.1 X |
| 4,869,382 | 9/1989 | Thompson | 215/12.1 |
| 4,979,628 | 12/1990 | Robbins, III | 220/403 X |
| 5,014,872 | 5/1991 | Robbins, III | 215/12.1 X |
| 5,054,631 | 10/1991 | Robbins, III | 215/1 C X |
| 5,174,458 | 12/1992 | Segati | 215/1 C |
| 5,203,470 | 4/1993 | Brown | 220/461 X |
| 5,228,589 | 7/1993 | Della Riva | 220/462 |

FOREIGN PATENT DOCUMENTS

| | | | |
|---|---|---|---|
| 622982 | 6/1927 | France | 215/12.1 |
| 2013654 | 4/1970 | France . | |
| 2166173 | 8/1973 | France . | |
| 2402592 | 5/1979 | France | 215/12.1 |
| 2575648 | 7/1986 | France | 215/12.1 |
| 2066765 | 7/1981 | United Kingdom | 215/12.1 |

*Primary Examiner*—Sue A. Weaver

*Attorney, Agent, or Firm*—Shlesinger, Fitzsimmons, Shlesinger

[57] ABSTRACT

A container comprises a containment receptable (11) of yielding plastic material which is inserted in a generally box-like rigid supporting shell (12) to project above it with a portion (20) thereof comprising a pouring neck (13). The side wall of said receptable displays projections (14, 15) received in corresponding openings (16, 17) in the shell and preventing withdrawal.

12 Claims, 3 Drawing Sheets

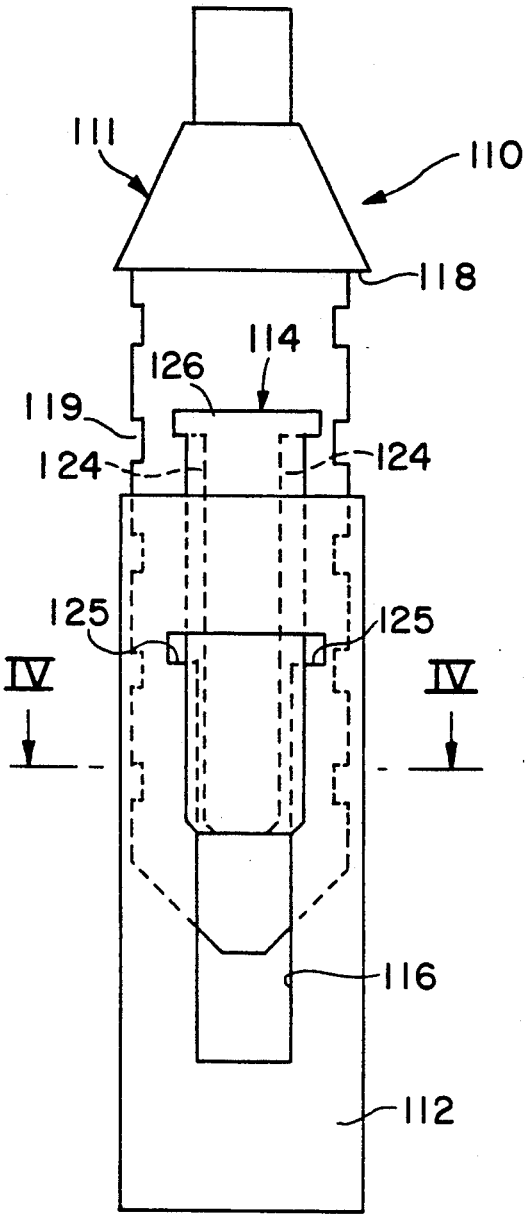
FIG. 3
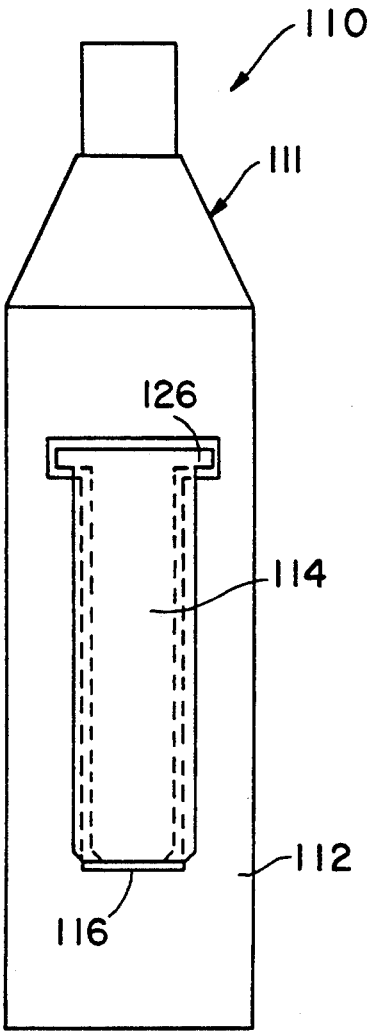
FIG. 5
FIG. 4
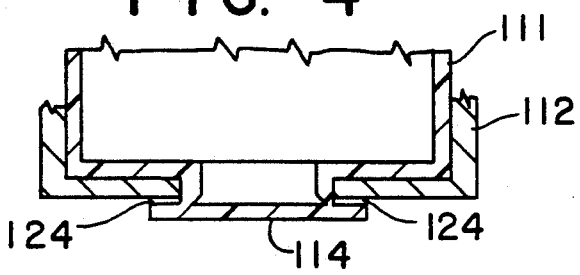

CONTAINER WITH COMPOSITE STRUCTURE

BACKGROUND OF THE INVENTION

In the production of plastic containers, in general not reusable, in the form of bottles, phials and the like, the problem of the difficulty of eliminating said containers once emptied because of their physical dimensions or their polluting characteristics is becoming more acute because of their poor degradability in time.

On the other hand these containers require rigidity sufficient for good stability and easy handling in use, transportation and storage.

This cannot be secured without a certain wall thickness and the resulting relatively high quantity of material, which reflects negatively on the product cost.

In the know art have been proposed composite bottles, i.e. formed of a relatively yielding plastic containing an element inserted in a more rigid supporting structure.

For example, in French patent application FR-A-2 166 173 is shown a substantially cylindrical composite container consisting of a rigid external tube in which is fixed a plastic receptacle. The receptacle of such a container must however have relatively thick walls. Otherwise the receptacle would tend to fold back on itself, slipping into the stiffening tube. In addition, during pouring, the receptacle would slip easily out of the tube due to the the weight of its contents.

In French patent application FR-A-2 013 654 there is proposed a container substantially similar to the above with the only variant being that the side wall of the cylindrical receptacle has projections for engagement with corresponding holes in the external supporting shell.

Although this embodiment ensures better fixing between the shell and the receptacle, when the latter is full or under pressure a rather high rigidity of the receptacle walls is still necessary to prevent collapsing or slipping out during pouring or when it is partly empty. In effect, the container described in said patent has its utility simply in the greater resistance to internal pressure given by the spherical bottom of the receptacle while the cylindrical external shell serves only to provide the container with a flat resting base.

In addition to wasting plastic material, the need for using receptacle with relatively rigid walls results in the difficulty of folding the container once emptied to reduce its space occupied and facilitate its disposal.

In U.S. Pat. No. US-A-4 456 334 are shown various solutions in which the cylindrical bottles are formed to have a containing part supported by a rigid part. The containing parts are readily folded either because made of very thin and easily deformed plastic material or due to the presence of bellows or the like. With bellows, the expenditure for plastic material is great while with thin walls the supporting part made at the same time of plastic is particularly complicated and costly and hence unsuited for a single us.

SUMMARY OF THE INVENTION

The general object of the present invention is to obviate the above mentioned drawbacks by providing a throw-away bottle formed with small quantities of plastic materials thanks to a composite structure provided with a containment part of thin-wall plastic inserted in a low-cost supporting part, e.g. of cardboard. The two parts work together to provide a rigidity of the assembly allowing firm gripping and convenience in use. Simultaneously, through their separation the two parts are readily folded to reduce their space occupied and facilitate their disposal.

In view of said object it is sought to provide in accordance with the present invention a bottle comprising a containing receptacle of yielding plastic material fitted with minimal side play in a generally boxed shell of greater rigidity to protrude from the upper edge thereof with a portion of its own comprising a pouring neck and characterized in that it has a generally rectangular plan to form paired facing side walls of different amplitude, the pair of side walls of lesser amplitude of said receptacle including projections received in corresponding openings in the shell. To further clarify the explanation of the innovative principles of the present invention and its advantages as compared with the known art there is described below with the aid of the annexed drawings possible embodiments as examples applying said principles.

BRIEF DESCRIPTION OF THE DRAWINGS

In the drawings:

FIG. 3 shows a side view of another embodiment partially assembled of the container of FIG. 1.

FIG. 4 shows a cross section view along plane of cut IV—IV of FIG. 3.

FIG. 5 shows a side view of the container of FIG. 3 assembled.

DETAILED DESCRIPTION OF THE PREFERRED EMBODIMENTS

With reference to the FIGS.

Figure 1:
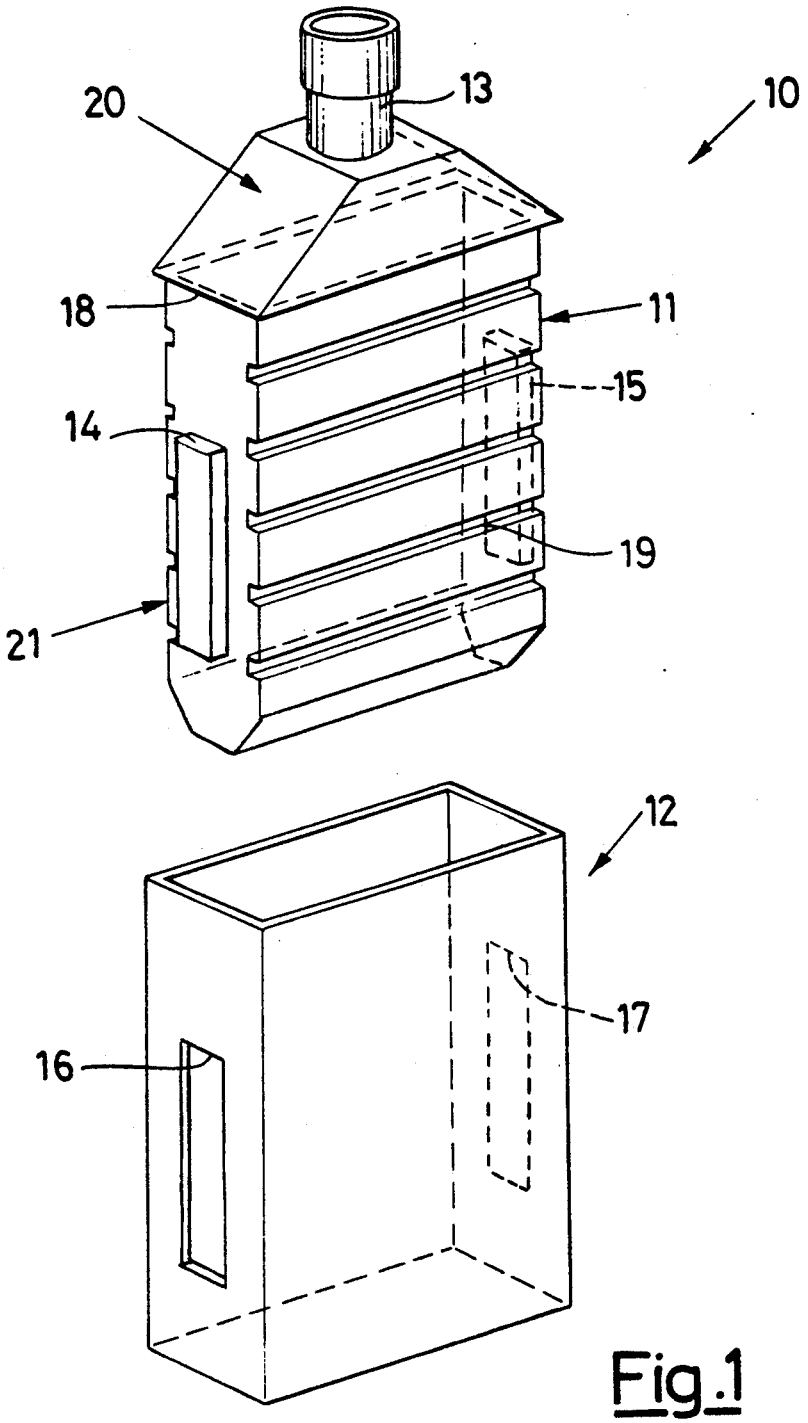
FIG. 1 shows an exploded perspective view of a container provided in accordance with the present invention.

FIG. 1 shows a schematic exploded perspective view of a container with generally rectangular plan 10 such as a bottle or phial consisting in accordance with the present invention of a receptacle 11 fitted with minimal side play in a box-like supporting shell 12 open at the top. The receptacle 11 has a top part with pouring neck 13 and is insertable in the box-like element 12 until it engages with its engagement projections or side tabs 14 and 15 (arranged on the narrower facing side walls) in corresponding side openings 16 and 17 in the shell 12. In this position the top of the receptacle 11 projects from the outer shell 12.

The receptacle can have its upper part 20 provided on its four sides or only in two opposite sides with an edge 18 projecting laterally and designed to butt against the upper edge of the shell 12.

However, the engagement of the side tabs 14 and 15 in the openings 16 and 17 is sufficient to support the internal container 11 even if the edge 18 is avoided.

Figure 2:
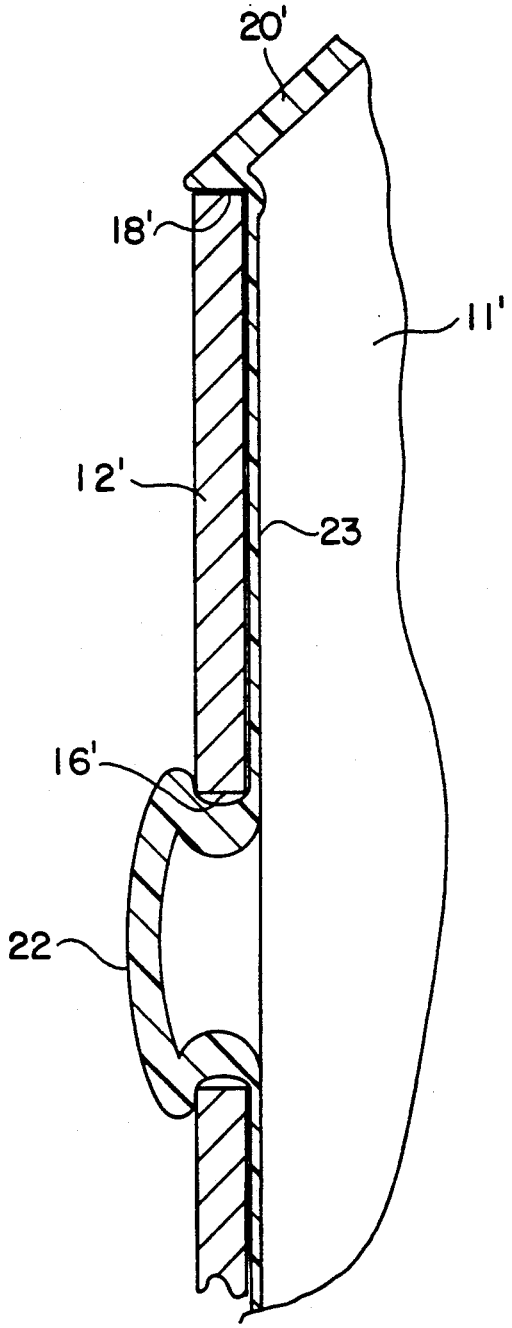
FIG. 2 shows an enlarged view of a cross section of a detail of a different embodiment of the container of FIG. 1.

The tabs 14 and 15 in the embodiment of FIGS. 1 and 2 have a rectangular form elongated longitudinally in relation to the receptacle and their upper edge constitutes an obstacle to withdrawal of the receptacle from the shell. Optionally their lower edge can be tapered downward to facilitate insertion of the receptacle in the supporting shell.

The receptacle 11 can be formed of thin plastic material, typically thermo-plastic resin, while the outer shell 12 is provided in cardboard folded to form a box.

Material of similar mechanical characteristics can of course replace the cardboard, which may be considered quite appropriate for making the shell.

By box-like form of the shell is intended a form folded to form vertical dihedrals which provide a rigid structure. It is not necessary to provide a closed and unbroken bottom wall and the shell can also have the form of a simple side band with the function of allowing the plastic receptacle to stand up while giving the assembly the desired rigidity.

However, the bottom part gives greater rigidity and a greater resting surface.

By the term 'thin' it is intended that the plastic of the container, at least in its part 21 which is received in the shell 12, has a thickness such as to be yielding and hence readily folded since it has practically no support function.

It might also be sought to provide the receptacle 11 with differentiated thickness of the different zones of the walls, i.e. with its part 21 which inserts in the shell 12 made very thin and its part 20 near the upper neck 13 and projecting from the shell, provided with greater thickness to be less yielding and hence have a certain rigidity, necessary for support of the pouring neck, even for the normal stresses to which it will foreseeably be subjected in use.

In any container, material rigidity being equal, the broader walls are more deformable than the narrower ones. In the embodiment of the present composite container it is sought to avoid the need of a containment structure 12 with the relatively high rigidity which would be necessary only to prevent deformation of the broader walls. Said greater rigidity would have made necessary a shell 12 of higher cost and more difficult elimination, contrary to the objects of the present invention.

On the two facing side walls of greater breadth the receptacle 11 has therefore transverse shapings or grooves 19 which form a stiffening plurality of ribs to oppose the deformation of the receptacle against normal forces on the narrower side walls.

Thanks to this provision it has been found that, while providing the internal container 11 with thin walls and providing the external shell 12 with relatively reduced rigidity their combination allows realization of a bottle of optimal rigidity and in any case sufficient for its normal use. Indeed, it has proven possible to use a shell whose rigidity is sufficient to support the transverse deformation forces along the narrower sides while for the broader sides the rigidity of the bottle is supplied by the combination of the rigidity of the external shell plus the rigidity of the shaped walls of the internal receptacle.

Stiffening of the greater side walls ensures also firm engagement of the tabs 14, 15 in their respective seats. When the receptacle 11 is withdrawn from the shell 12, the transverse shapings 19 also facilitate its longitudinal folding even unto rolling up to occupy the least space when it is disposed of.

In use the receptacles are sold assembled with their shells on which can be printed the various instructions and labels of the products contained in addition to having those decorations which would make it pleasing and adequate for the value of the contents, despite the relative poorness and low cost of the components of the total product provided in accordance with the present invention.

The stiffness of the assembly is also assured by the outer shell and permits normal use of the bottle or phial 10 as well as firm grasping and good resistance to handling even during filling, storage and transport.

When the contained product has been exhausted it is sufficient to press from the outside the fins 14 and 15 to be able to withdraw the container from the shell which as an alternative can be merely torn to free the receptacle held therein.

The shell can then be folded and optionally torn up while the receptacle can be readily folded to reduce its dimensions.

For example, the part 21 can be curled up inside the part 20, optionally provided stiffer, or the receptacle could be crushed and rolled up from the bottom, even thanks to the facilitating grooves 19.

It could also be conceived to tear the shell directly from the receptacle and then fold the latter as mentioned above.

To facilitate folding, the receptacle can have, as shown in the drawing, a generally flattened form with tapering of the base to avoid stiffening of a boxed form of the bottom, and with the optional additional roll-up-facilitating indentations arranged on the broader side walls.

At this point it is clear that the objects of furnishing folding containers employing little plastic material thanks to the thinness of the walls and facilitating disposal with minimal space occupied are achieved.

Naturally the above description of an embodiment applying the innovative principles of the present invention is given merely byway of example and therefore is not to be taken as a limitation of the patent right claimed here.

In particular the configuration, arrangement and dimensions of the projections of the receptacle which are inserted in openings in the shell to hold it therein, can be freely varied.

The projections may be one or more than one on each face. In the two opposite faces, projections do not have to be in equal number, and may be located in different positions and at different heights.

Projections may have the shape of horizontal thin rectangles, or of quarter moons or any convenient thin horizontal shape.

In this case and should the projections be more than one per face, the larger projections should be located nearer to the bottom so that they can overpass smaller openings and snap in the proper opening while receptacle is being inserted into shell for assembly.

It is readily imaginable to those skilled in the art that they can be varied to adapt them to particular requirements.

In particular, there can be provided projections not only retaining the receptacle against withdrawal, but also having the effect of holding them in the openings.

In other words, the projections can be designed to be forced into the openings and not only received therein freely.

For example, in particular in the case where the side walls of the receptacle would be so yielding as to not assure engagement of the tabs arranged thereon, the tabs could be placed on a stiffer part of the shell, e.g. near the edge 18.

The tabs could also be shorter with resulting lesser extension of the engagement openings. For example they could be shaped with substantially square form and with the aforesaid engagement facilitation tapering extended for their entire height.

FIG. 2 shows an example of a different embodiment of the couplings between the receptacle and the rigid shell.

In said embodiment a receptacle 11', otherwise similar to the receptacle 11 of FIG. 1, engages in a shell 12' by means of projections 22 (of which only one is shown, the other being the same on the other wall), provided instead of the tabs 14, 15.

As can be seen in FIG. 2, the receptacle has its upper part 20' protruding from the shell 12' and connectors 22 provided optionally with greater thickness of the side wall 23.

The connector 22 can be provided in hollow mushroom form to engage with the widened head on the edge of a hole 16' in the shell.

Thanks to the relative rigidity of the upper part 20, which rests with its peripheral edge 18' on the top edge of the shell 12', and to the mushroom shape of the connection 22, the thin yielding side wall 23 remains in tension and the receptacle is firmly anchored to the shell.

The receptacle 11' can advantageously be provided or prearranged with the connectors folded inward to be readily inserted in the shell 12' without resistance. It then is sufficient to produce a slight over pressure in the receptacle, so as to swell it and push the connectors to pass through the holes 16', and anchor themselves therein.

Essentially, in accordance with the present invention, anchoring of the two parts of the container takes place by insertion of projections of the receptacle in openings in the shell and said insertion takes place advantageously by deformation of the thin wall of the receptacle.

The deformation, which introduces the projections in the openings, can take place under the effect of mechanical means or a depression or an over pressure of air or other fluids and in any case by any effect which can be exerted on the plastic receptacle for the purpose of producing the anchoring.

Internal over pressure can be readily obtained by blowing in air or during automatic or manual filling of the receptacle by utilizing the pressure of the product placed in said receptacle as readily imaginable by those skilled in the art.

The form of the projection 22 can be different from that of a mushroom as illustrated, for example in the form of a round button or of any polygonal periphery, on a pair of preferably opposite sides, being provided undercut, which can be inserted with a snap in the corresponding holes of the shell.

FIG. 3 shows another possible embodiment indicated generally by reference number 110 of a bottle in accordance with the present invention.

The bottle with square plan 110 (for the sake of clarity the same details as those of the bottle 10 are indicated below with the same numbers plus 100) includes a bottle receptacle 111 with thin walls insertable with minimal play in a shell 112, e.g. of cardboard. Again similarly to the bottle 10, the receptacle 111 may include a step or edge 118 for resting on the upper edge of the shell 112 and grooves 119 for transverse stiffening and facilitation of longitudinal folding.

The receptacle 111 includes, on its smaller walls, side tongue joints for connection in corresponding openings in the walls of the shell 112.

The tongues and openings being identical con both sides of the bottle, only one tongue 114 and one opening 116 of one side are shown. In the description set forth below explicit reference is made only to said side, it being clearing intended that the same description applies to the opposite side also.

The tongue 114 has a form longitudinally elongated in relation to the bottle and includes on the side walls two undercuts 124 each identifying a groove in which is received a respective side edge of the opening 116 as may be well seen in FIG. 4.

To allow introduction of the edges in the grooves during introduction of the receptacle in the shell the opening 116 is formed generally like the letter T with the cross piece or top cut 125 forming facilitation points for insertion of the side edges of the openings 116 in the grooves 124.

The tongue 114 has a corresponding T shape with a cross piece 126 at its top end constituting the terminal closing element for the grooves 124. Advantageously the corners of the lower end of the tongue are rounded to facilitate insertion of the tongue in the opening.

As may be well seen in FIG. 5, when the receptacle is completely inserted in the shell the cross piece 126 of the tongue 114 constitutes a stop by fitting into the cut 125 and preventing accidental withdrawal.

It is clear that the embodiment 110 allows ready assembly of the bottle even by automatic devices.

I claim:

1. A bottle (10, 110) comprising in combination, an elongate containment receptacle (11, 11', 111) made of a yielding plastic material and a generally box-like rigid supporting shell (12, 12', 112), said receptacle having a lower portion thereof inserted in said shell, and an upper portion (20, 20') comprising a pouring neck (13) projecting above said shell, and characterized in that said lower portion of said receptacle has a generally rectangular configuration thus to form two pairs of spaced, confronting side walls of a different breadth, whereby one of the said pairs of walls is narrower than the other pair thereof, and the narrower side wall pair of said receptacle (11, 11', 111) having thereon projection (14, 15, 22, 114) received in corresponding registering openings (16, 16', 17, 116) formed in said shell (12, 12', 112).

2. Bottle in accordance with claim 1 characterezed in that each of said other pair of said walls of the receptacle have therein spaced, transverse grooves (19, 110) which form thereon spaced, parallel ribs for stiffening said other pair of side walls against deformation forces acting normally on the narrower pair of side walls.

3. Bottle in accordance with claim 2 characterized in that the transverse grooves (19, 119) also constitute means to facilitate folding of the receptacle (11, 11', 111) longitudinally.

4. Bottle in accordance with claim 1 characterized in that the shell (12, 12', 112) is provided in the form of a cardboard box.

5. Bottle in accordance with claim 1 characterized in that the upper portion (20, 20') of the receptacle projecting above said shell (12, 12', 112) is less yielding than said lower portion thereof (21) that is received in said shell.

6. Bottle in accordance with claim 1 characterized in that the engagement projections have a configuration with widened mushroom head (22) to engage with the edges of the openings (16') of the shell.

7. Bottle in accordance with claim 1 characterized in that the engagement projections (14, 15) have a form tapered in the direction of insertion of the receptacle (11) in the shell (12) to form a facilitation for introduction of the receptacle (11) in the shell (12) and have thereon a stop against withdrawal of the receptacle (11) from the shell (12).

8. Bottle in accordance with claim 1 characterized in that the receptacle (11, 11', 111) includes a peripheral stop edge (18, 18', 118) engageable with the upper edge of the shell (12, 12', 112) at least on two opposite sides thereof.

9. Bottle in accordance with claim 1 characterized in that the receptacle (11, 11', 111) has a tapered bottom.

10. Bottle in accordance with claim 1 characterized in that said projections (114) extend longitudinally along the respective walls of said one pair thereof and have lateral undercuts forming grooves (124) for engagement with corresponding lateral edges of the registering openings in said shell.

11. Bottle in accordance with claim 10 characterized in that the openings (116) in said shell are generally in the shape of the letter T to form in the upper transverse part of the T-shaped opening (125) points of facilitation for insertion of the lateral edges of the openings (116) into said grooves (124) in said projections upon insertion of the receptacle (111) into the shell (112).

12. Bottle in accordance with claim 11 characterized in that the projections (114) also are generally in the form of the letter T and each has thereon an upper transverse part (126) disposed to project into and to form an engagement stop in the upper transverse part (125) of the registering opening in said shell.

* * * * *